US008669931B2

(12) United States Patent
Chang et al.

(10) Patent No.: US 8,669,931 B2
(45) Date of Patent: Mar. 11, 2014

(54) DRIVING METHOD AND APPARATUS FOR CHANGING GATE-ON SEQUENCE FOR A LIQUID CRYSTAL DISPLAY PANEL

(75) Inventors: Wan-Ju Chang, Hsinchu County (TW); Po-Tsun Chen, Hsinchu County (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 930 days.

(21) Appl. No.: 11/841,003

(22) Filed: Aug. 20, 2007

(65) Prior Publication Data

US 2008/0316158 A1 Dec. 25, 2008

(30) Foreign Application Priority Data

Jun. 23, 2007 (TW) ..... 96122792 A

(51) Int. Cl.
*G09G 3/36* (2006.01)

(52) U.S. Cl.
USPC ..... 345/100; 345/98

(58) Field of Classification Search
USPC ..... 345/98, 100
See application file for complete search history.

(56) References Cited

U.S. PATENT DOCUMENTS

| | | | | |
|---|---|---|---|---|
| 5,325,201 | A * | 6/1994 | Herz | 348/571 |
| 5,675,353 | A * | 10/1997 | Tanaka et al. | 345/96 |
| 5,831,588 | A * | 11/1998 | Hotto | 345/100 |
| 6,064,404 | A * | 5/2000 | Aras et al. | 345/530 |
| 6,310,591 | B1 * | 10/2001 | Morgan et al. | 345/84 |
| 6,563,483 | B1 * | 5/2003 | Sakumoto | 345/98 |
| 7,133,015 | B1 * | 11/2006 | Yoshida et al. | 345/99 |
| 7,518,590 | B2 * | 4/2009 | Yoshimoto | 345/98 |
| 7,616,200 | B1 * | 11/2009 | Heinrich et al. | 345/422 |
| 2004/0227714 | A1 * | 11/2004 | Furuichi | 345/98 |
| 2006/0106317 | A1 * | 5/2006 | McConnell et al. | 600/476 |
| 2006/0132405 | A1 * | 6/2006 | Bai et al. | 345/88 |
| 2007/0098271 | A1 * | 5/2007 | Kamata | 382/232 |
| 2007/0139356 | A1 * | 6/2007 | Lee et al. | 345/103 |
| 2008/0158180 | A1 * | 7/2008 | Krah et al. | 345/173 |

FOREIGN PATENT DOCUMENTS

| | | |
|---|---|---|
| TW | 525124 | 3/2003 |

* cited by examiner

*Primary Examiner* — Kwang-Su Yang
(74) *Attorney, Agent, or Firm* — Winston Hsu; Scott Margo

(57) ABSTRACT

A driving method for an LCD panel includes generating a sequence, generating a plurality of gate driving signals, determining a gate-on sequence of the plurality of gate driving signals according to the sequence, and driving pixels of the LCD panel using the plurality of gate driving signals according to the gate-on sequence for displaying images.

10 Claims, 10 Drawing Sheets

DRIVING METHOD AND APPARATUS FOR CHANGING GATE-ON SEQUENCE FOR A LIQUID CRYSTAL DISPLAY PANEL

BACKGROUND OF THE INVENTION

1. Field of the Invention

The present invention is related to a driving method and apparatus for driving an LCD panel, and more particularly, to a driving method and apparatus for reducing a vertical-line effect by randomly changing a gate-on sequence, so as to enhance image quality.

2. Description of the Prior Art

A liquid crystal display (LCD) monitor has characteristics of light shape, low power consumption, zero radiation, etc., and has been widely used in many information technology (IT) products, such as computer systems, mobile phones, and personal digital assistants (PDAs). The operating principle of the LCD is based on the fact that liquid crystals in different twist status can result in different polarization and refraction effects on lights. Thus, the liquid crystals can control penetration amount of light by arranging in different twist status, so as to produce various brightness of light output and diverse gray levels of red, green and blue lights.

Please refer to FIG. 1. FIG. 1 is a schematic diagram of a thin-film-transistor (TFT) LCD monitor 10 according to the prior art. The LCD monitor 10 includes an LCD panel 100, a control circuit 102, a data-line-signal output circuit 104, a scan-line-signal output circuit 106, and a voltage generator 108. The LCD panel 100 is formed with two substrates, and LCD layers are stuffed between the substrates. One substrate includes a plurality of data lines 110, a plurality of scan lines (or gate lines) 112 perpendicular to the data lines 110, and a plurality of TFTs 114. The other substrate includes a common electrode for providing a common voltage Vcom generated by the voltage generator 108. For the sake of brevity, FIG. 1 reveals only four TFTs 114, but in a real case, there is one TFT 114 set at each intersection of a data line 110 and a scan line 112 on the LCD panel 100. In other words, the plurality of TFTs 114, each corresponding to a pixel, form a matrix on the LCD panel 100, and the data lines 110 and the scan lines 112 are corresponding to columns and rows of the matrix. In addition, a circuit effect resulted from the two substrates of the LCD panel 100 can be regarded as equivalent capacitors 116.

A driving process of the prior art TFT LCD monitor 10 is described in details as follows. When the control circuit 102 receives a horizontal synchronization signal 118 and a vertical synchronization signal 120, the control circuit 102 generates corresponding control signals for the data-line-signal output circuit 104 and the scan-line-signal output circuit 106. The data-line-signal output circuit 104 and the scan-line-signal output circuit 106 generate input signals for the data lines 110 and the scan lines 112 according to the control signals, in order to control the TFTs 114 and voltage differences of the equivalent capacitors 116. The voltage differences change twist of liquid crystals and corresponding penetration amount of light so as to display the display data 122 on a panel.

On the other hand, as those skilled in the art recognized, every color is composed of red, green, and blue, named three primary colors. Therefore, in the LCD panel 100, each dot is practically composed of pixels corresponding to red, green, and blue. Please refer to FIG. 2. FIG. 2 illustrates a schematic diagram of pixel alignment in the LCD panel 100. In the FIG. 2, R, G, B respectively represent pixels corresponding to red, green, and blue, G1~Gn represent gate driving signals outputted by the scan line signal output circuit 106, and S1~S2*m* represent source driving signals outputted by the data line signal output circuit 104. When displaying images, the scan line signal output circuit 106 outputs the gate-driving signals G1~Gn for sequentially turning on pixels in each row, and the data line signal output circuit 104 controls R, G, B pixels of each dot for generating corresponding colors and gray levels according to the display data 122.

In order to save the number of data line signals and distribute pixels more effectively, the prior art provides an LCD, which controls pixels in the same row by at least two gate-driving signals. Please refer to FIG. 3. FIG. 3 illustrates a schematic diagram of pixel alignment in a prior art LCD panel 300. As shown in FIG. 3, pixels in a row are controlled by two gate-driving signals (e.g. the first row is controlled by G1 and G2, and the second row is controlled by G3 and G4, etc). When displaying images through the LCD panel 300, a scan line signal output circuit of the LCD panel 300 outputs gate-driving signals G1~G2*n* for turning on pixels in each row, so as to display images according to source driving signals S1~Sm. In this case, odd and even pixels in a row are alternatively turned on, and pixels in adjacent rows are controlled by a source driving signal, so that the LCD panel 300 has a vertical-line effect, which lowers image quality and reduce the application range.

SUMMARY OF THE INVENTION

It is therefore a primary objective of the claimed invention to provide a driving method and related apparatus for driving an LCD panel.

The invention discloses a driving method for an LCD panel, which comprises generating a sequence, generating a plurality of gate driving signals, determining a gate-on sequence of the plurality of gate driving signals according to the sequence, and driving pixels of the LCD panel using the plurality of gate driving signals according to the gate-on sequence for displaying images.

The invention discloses a driving device for an LCD panel, which comprises a sequence generator for generating a sequence, a gate driving signal generation unit for generating a plurality of gate driving signals, a gate-on sequence determination unit coupled to the sequence generator for determining a gate-on sequence of the plurality of gate driving signals according to the sequence, and an output unit coupled to the gate driving signal generation unit and the gate-on sequence determination unit for driving pixels of the LCD panel using the plurality of gate driving signals according to the gate-on sequence for displaying images.

These and other objectives of the present invention will no doubt become obvious to those of ordinary skill in the art after reading the following detailed description of the preferred embodiment that is illustrated in the various figures and drawings.

DETAILED DESCRIPTION

Figure 4:
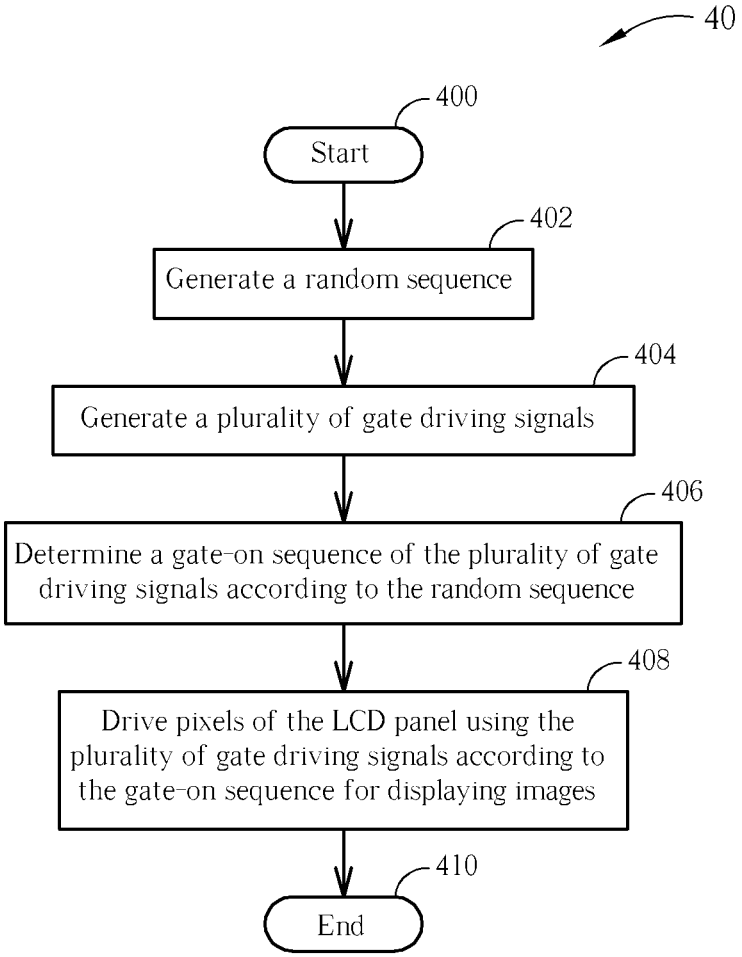
FIG. 4 illustrates a flow chart according to an embodiment of the present invention.

Please refer to FIG. 4. FIG. 4 illustrates a schematic diagram of a process 40 according to an embodiment of the present invention. The process 40 is utilized for driving an LCD panel. Preferably, in the LCD panel, pixels in a row are controlled by at least two gate driving signals, and each source driving signal controls pixels in two columns. The process 40 comprises the following steps:

Step 400: Start.

Step 402: Generate a random sequence.

Step 404: Generate a plurality of gate driving signals.

Step 406: Determine a gate-on sequence of the plurality of gate driving signals according to the random sequence.

Step 408: Drive pixels of the LCD panel using the plurality of gate driving signals according to the gate-on sequence for displaying images.

Step 410: end

In the process 40, the present invention determines a gate-on sequence of the plurality of gate driving signals according to the random sequence and drives the pixels of the LCD panel according to the gate-on sequence for displaying images. In other words, the present invention changes the gate-on sequence of the gate driving signals according to the random sequence, so as to reduce the vertical-line effect by vision persistence, and enhance image quality.

Figure 1:
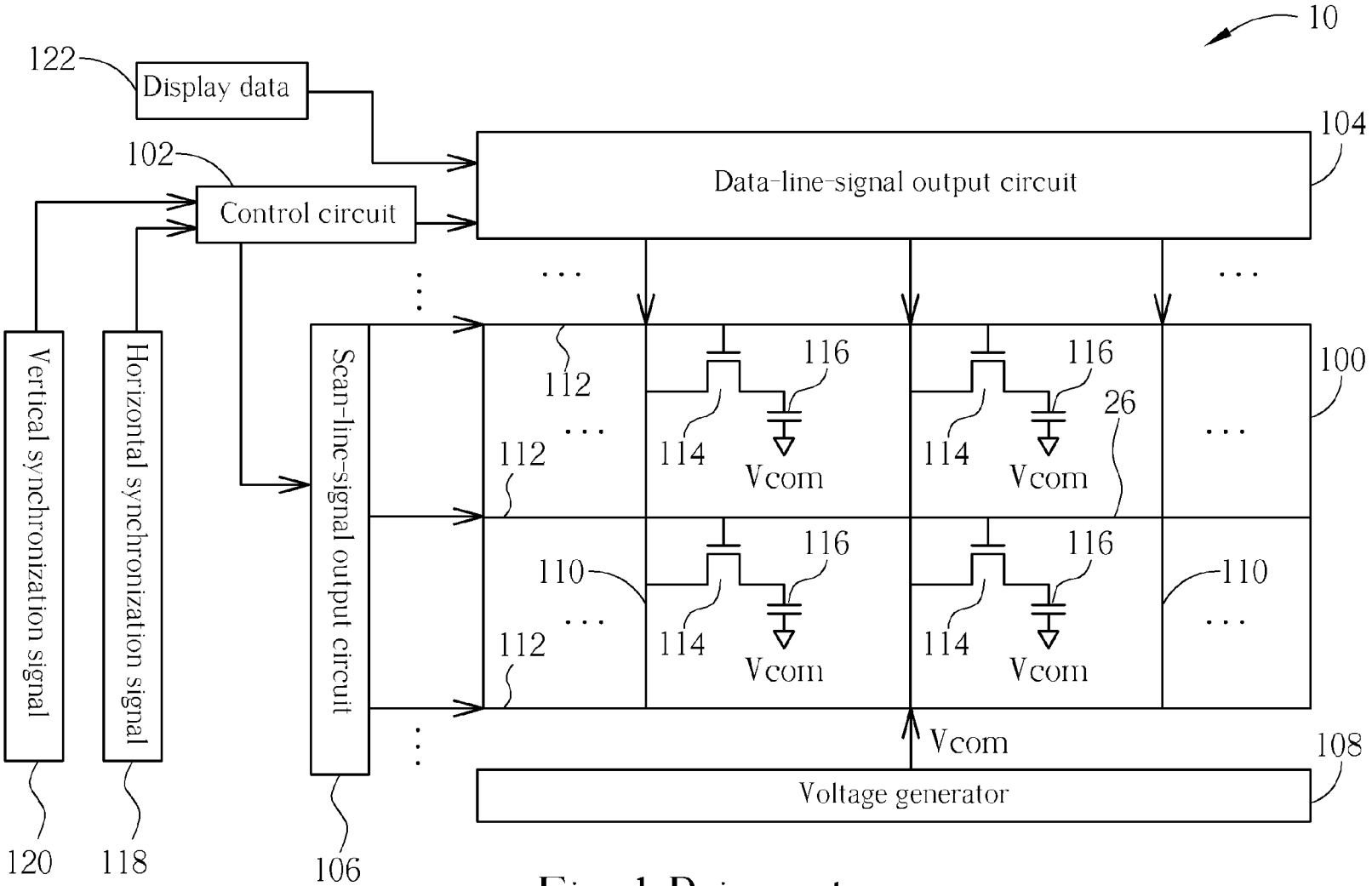
Fig. 1 Prior art
FIG. 1 illustrates a schematic diagram of a conventional TFT LCD.
Figure 2:
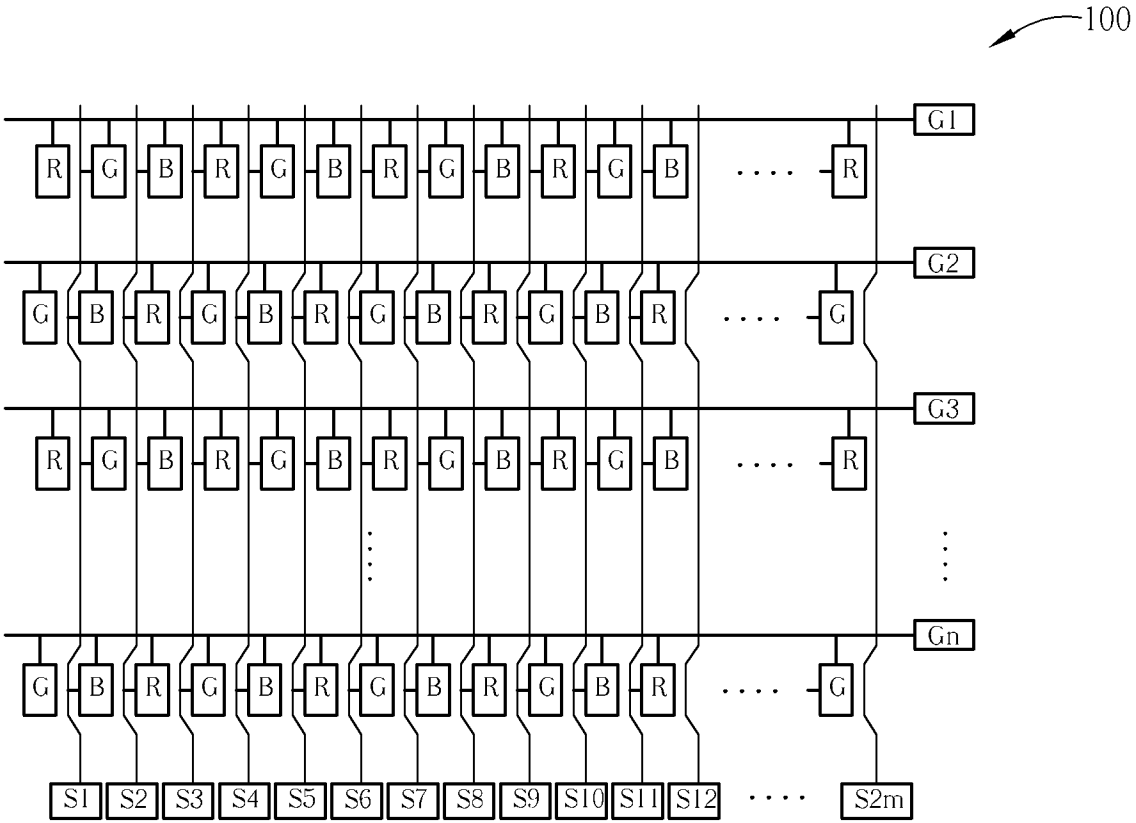
Fig. 2 Prior art
FIG. 2 illustrates a schematic diagram of pixel alignment in the LCD panel shown in FIG. 1.
Figure 3:
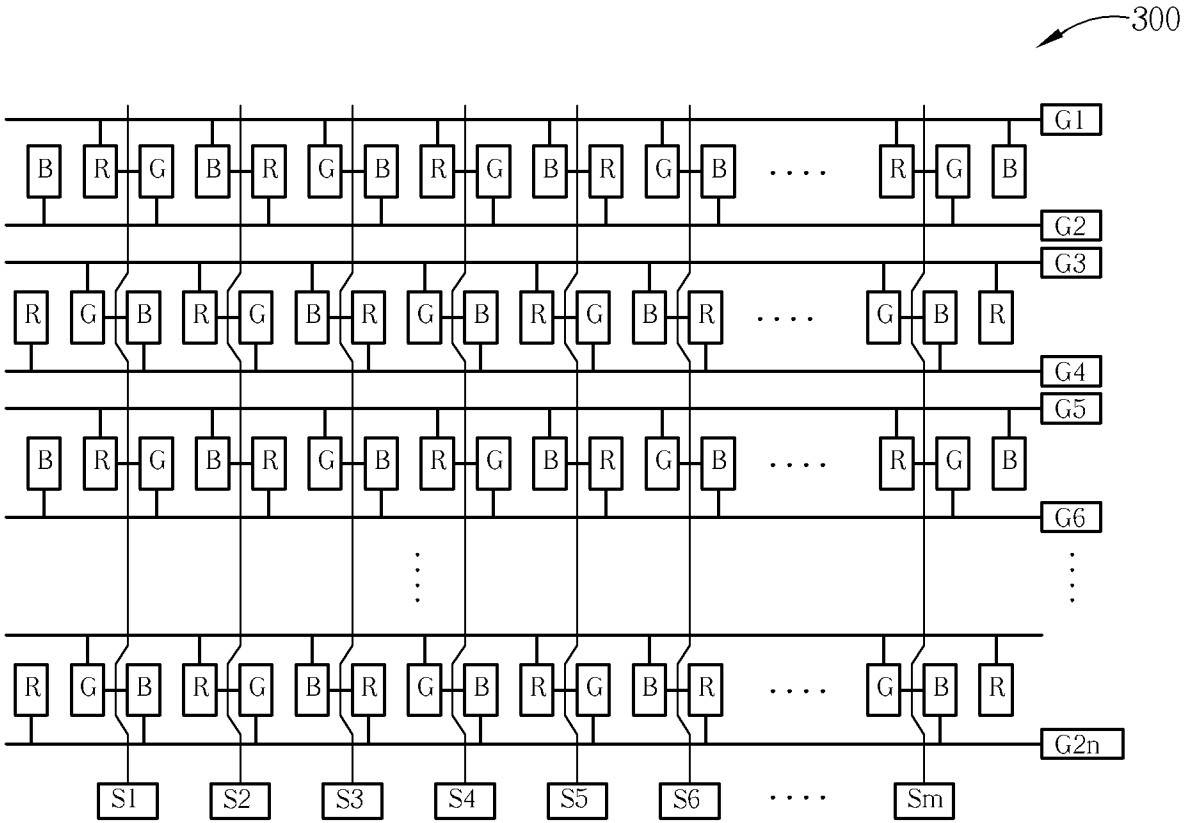
Fig. 3 Prior art
FIG. 3 illustrates a schematic diagram of pixel alignment in a prior art LCD panel.

An ideal random sequence is unpredictable, and occurrence times of values of the random sequence are the same. Therefore, when the process 40 drives the LCD panel 300 shown in FIG. 3, a gate-on sequence of the gate driving signals G1~G2*n* changes randomly, so that the vertical-line effect can be reduced.

The process 40 determines the gate-on sequence of the plurality of gate driving signals according to the random sequence, and can be implemented in different ways. For example, the present invention can preset a plurality of gate-on sequences each corresponding to a value of the random sequence, so as to determine a gate-on sequence according to a current value of the random sequence. Take driving the LCD panel 300 shown in FIG. 3 as an example. If the random sequence is composed of "0" and "1", "0" can be set to be corresponding to a first gate-on sequence: G1, G2, G3, G4 . . . G(2*n*−1), G2*n*, while "1" can be set to be corresponding to a second gate-on sequence: G2, G1, G4, G3 . . . G2*n*, G(2*n*−1). Since the random sequence is unpredictable, and occurrence times of values of the random sequence are the same, the first gate-on sequence and the second gate-on sequence occur randomly, and occurrence times of the first gate-on sequence and the second gate-on sequence are the same. Therefore, the vertical-line effect can be reduced, so as to enhance image quality.

Besides, the present invention can divide the LCD panel into several groups by gate driving signals, and controls a gate-on sequence of gate driving signals in each group according to the random sequence. Take driving the LCD panel 300 shown in FIG. 3 as an example. G1~G4 can be set as a first group, G5~G9 can be set as a second group, and so forth. When a value of the random sequence corresponding to the first group is 0, the gate-on sequence of the first group is set as G1, G2, G3, and G4. When a value of the random sequence corresponding to the first group is 1, the gate-on sequence of the first group is set as G2, G1, G4, and G3. Gate-on sequences corresponding to other groups can be set by the same rule. As a result, the LCD panel 300 drives each row according to the random sequence so as to reduce the vertical-line effect.

Note that, the above-mentioned embodiments are utilized for illustrating the present invention, and those skilled in the art can derive variations. For example, instead of using the random sequence, the present invention can obtain a specific sequence capable of reducing the vertical-line effect according to experimental results, and use the specific sequence for displaying images afterward.

Figure 5:
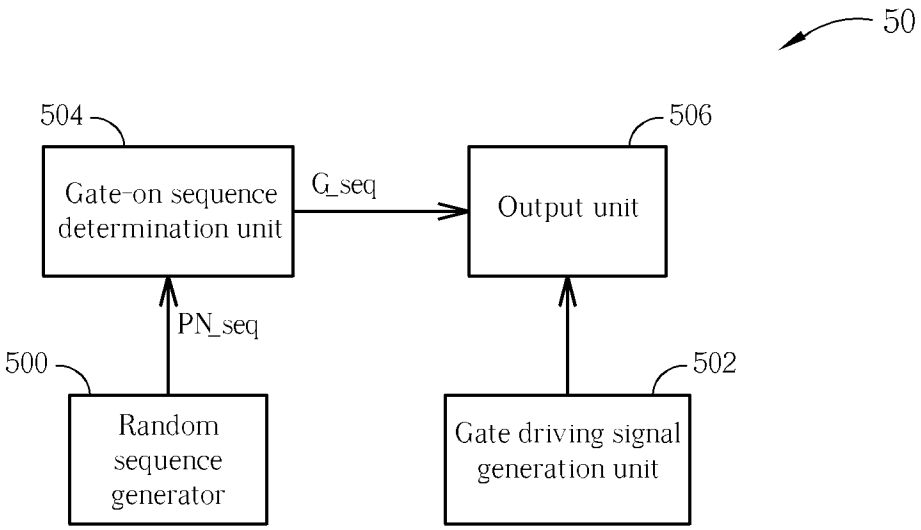
FIG. 5 illustrates a function block diagram of a driving device of a LCD panel according to an embodiment of the present invention.

Please refer to FIG. 5. FIG. 5 illustrates a function block diagram of a driving device 50 for an LCD panel according to an embodiment of the present invention. Preferably, in the LCD panel, pixels in a row are controlled by at least two gate driving signals, and each source driving signal controls pixels in two columns. The driving device 50 is utilized for implementing the process 40, and comprises a random sequence generator 500, a gate driving signal generation unit 502, a gate-on sequence determination unit 504, and an output unit 506. The random sequence generator 500 is utilized for generating a random sequence PN_seq. The gate driving signal generation unit 502 is utilized for generating a plurality of gate driving signals. The gate-on sequence determination unit 504 is utilized for determining a gate-on sequence G_seq according the random sequence PN_seq generated by the random sequence generator 500. The output unit 506 is utilized for outputting the gate driving signals generated by the gate driving signal generation unit 502 according to the gate-on sequence G_seq determined by the gate-on sequence determination unit 504, so as to drive pixels of each row of the LCD panel for displaying images.

Therefore, in the driving device 50, the gate-on sequence determination unit 504 determines the gate-on sequence according to the random sequence generated by the random sequence generator 500, and the output unit 506 outputs the gate driving signals generated by the gate driving signal generation unit 502 according to the random sequence. In other words, the driving device 50 changes the gate-on sequence of the gate driving signals according to the random sequence PN_seq, so as to reduce the vertical-line effect by vision persistence, and enhance the image quality.

As mentioned previously, an ideal sequence is unpredictable, and occurrence times of values of the random sequence are the same. Therefore, when the driving device 50 drives the LCD panel 300 shown in FIG. 3, the gate-on sequence of the gate driving signals G1~G2*n* changes randomly, so as to improve the vertical-line effect.

Figure 6:
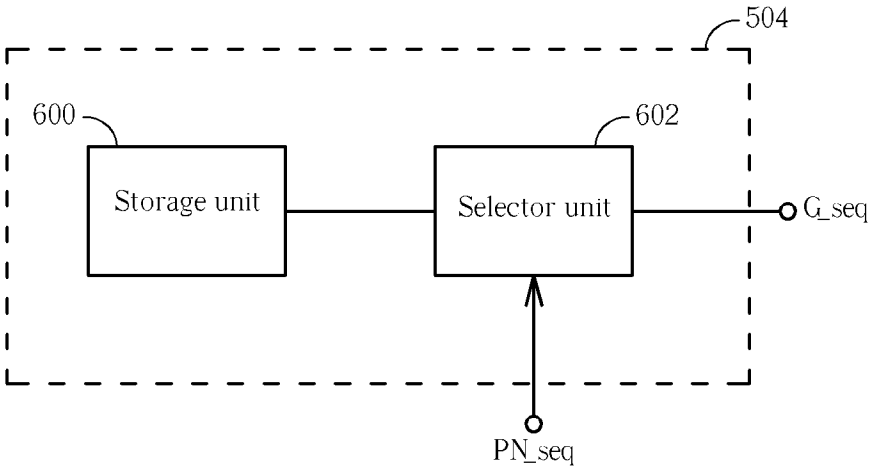
FIG. 6 illustrates a schematic diagram of an embodiment of the gate-on sequence determination unit shown in FIG. 5.

Note that, the functional block diagram shown in FIG. 5 is utilized as an embodiment, not a limitation of the present invention. The present invention can be implemented in different ways. For example, please refer to FIG. 6. FIG. 6 illustrates a schematic diagram of an embodiment of the gate-on sequence determination unit 504 shown in FIG. 5. The gate-on sequence determination unit 504 comprises a storage unit 600 and a selector unit 602. The storage unit 600 is utilized for storing a plurality of gate-on sequences corresponding to values of the sequence PN_seq, and the selector unit 602 selects the gate-on sequence G_seq from the storage unit 600 according to the random sequence PN_seq generated by the random sequence generator 500. As a result, since the random sequence PN_seq is unpredictable, and occurrence times of values of the random sequence PN_seq are the same, the gate-on sequences stored in the storage unit 600 occur randomly and the occurrence times of the gate-on sequences are the same. Therefore, the vertical-line effect can be reduced, so as to enhance the image quality.

Figure 7:
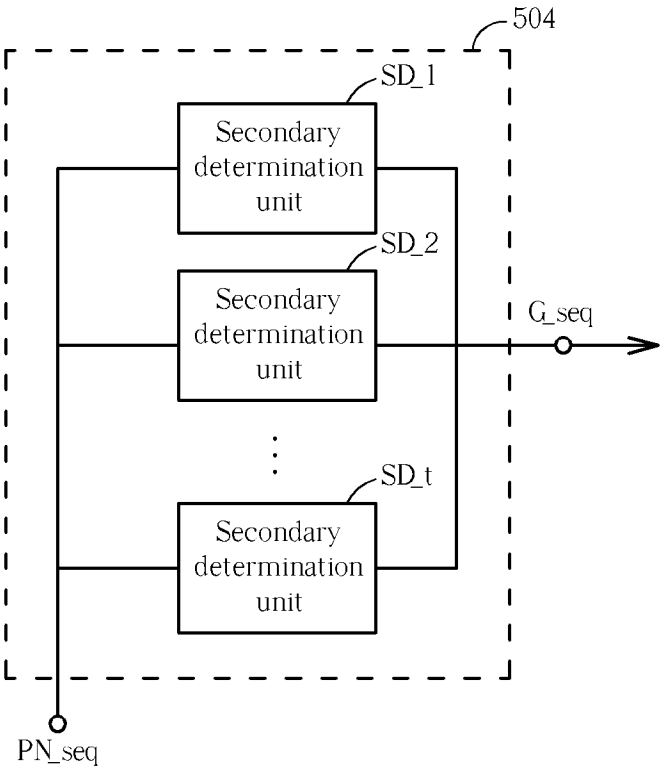
FIG. 7 illustrates a schematic diagram of another embodiment of the gate-on sequence determination unit shown in FIG. 5.

Besides, the gate-on sequence determination unit 504 also can divide the LCD panel into several groups by the gate driving signals and respectively determine the gate-on sequence of the gate driving signals of each group according to the sequence PN_seq. Please refer to FIG. 7. FIG. 7 illustrates a schematic diagram according to another embodiment of the gate-on sequence determination unit 504 shown in FIG. 5. In FIG. 7, the gate-on sequence determination unit 504 comprises a plurality of secondary determination units SD_1~SD_t. Each secondary determination unit corresponds to a group and is composed of a storage unit and a selector unit (e.g. the configuration shown in FIG. 6) utilized for determining the gate-on sequence of the gate driving signals of each group according to the sequence PN_seq. Taking driving the LCD panel 300 shown in FIG. 3 as an example, G1~G4 can be set as a first group corresponding to the secondary determination unit SD_1, and G5~G9 can be set as a second group corresponding to the secondary determination unit SD_2, and so forth. When the value of the sequence received by the secondary determination unit SD_1 is 0, set the gate-on sequence of the first group as G1, G2, G3, G4, and when the value of the sequence received by the secondary determination unit SD_1 is 1, set the gate-on sequence of the first group as G2, G1, G4, G3. Similarly, other groups set the gate-on sequence according to the rule. As a result, the LCD panel 300 drives each row according to the sequence so as to improve vertical-line effect.

Figure 8:
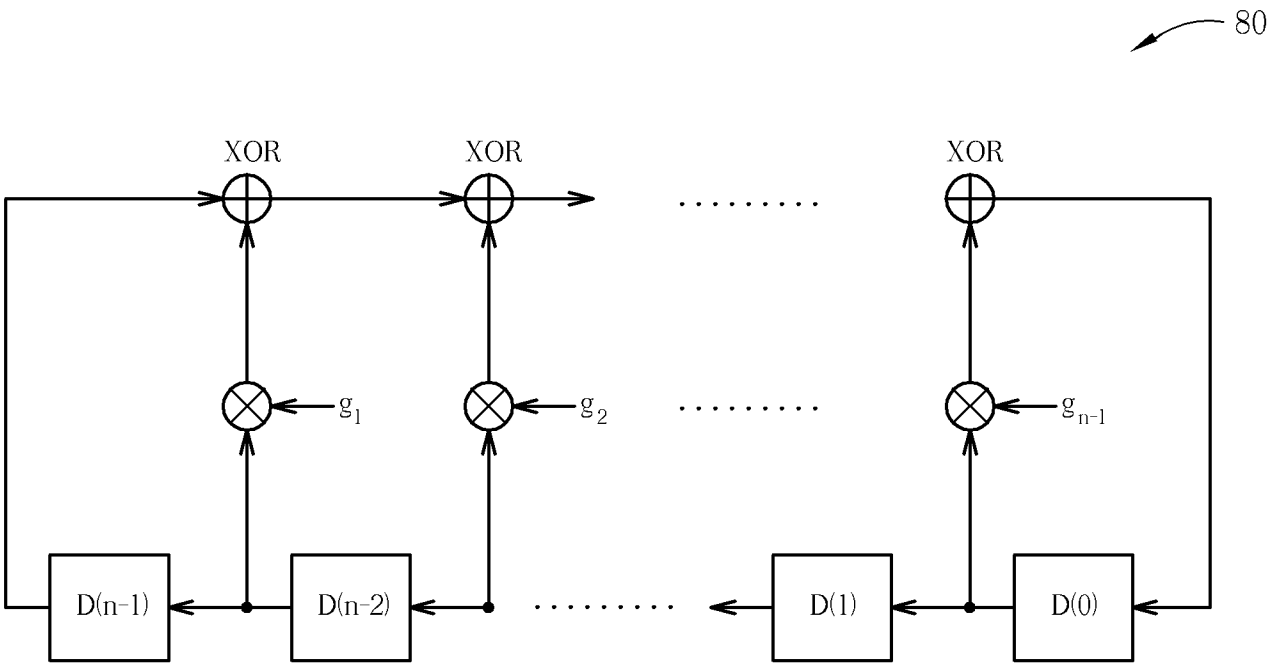
FIG. 8 and FIG. 9 illustrate schematic diagrams of linear feedback shift registers.
Figure 9:
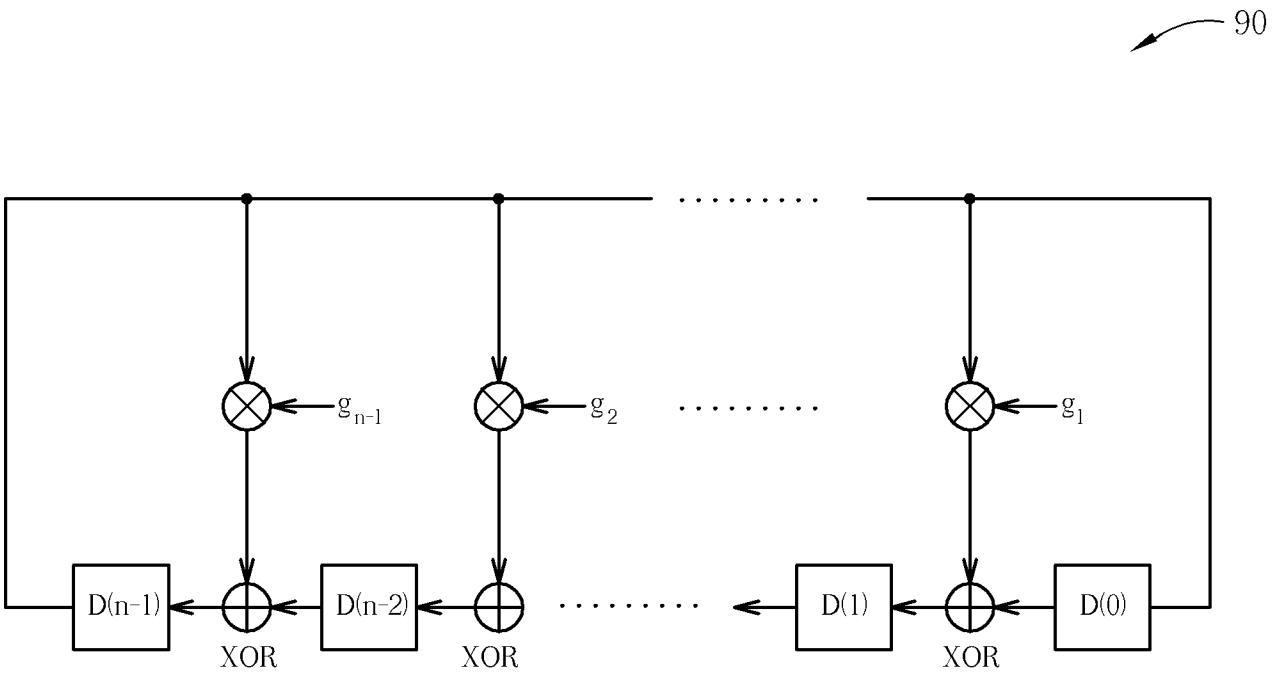

As mentioned previously, FIG. 5 is a function block diagram according to the present invention, and those skilled in the art can derive variations with different circuits based on requirements. For example, since generating an ideal random sequence requires enormous computations, the present invention can implement the random sequence generator 500 with a linear feedback shift register for generating cyclic pseudo random code or pseudo noise code, so as to reduce system cost. For example, please refer to FIG. 8 and FIG. 9. FIG. 8 and FIG. 9 illustrate schematic diagrams of linear feedback shift registers 80 and 90. The linear feedback shift registers 80 and 90 are both composed of shift registers D(0)~D(n−1) and XOR gates. The difference thereof is that the XOR gates of the linear feedback shift register 80 are installed outside a loop of the shift registers D(0)~D(n−1) and the XOR gates of the linear feedback shift register 90 are installed inside the loop of the shift registers D(0)~D(n−1). Both of them can realize a characteristic equation as follows:

$$g(x)=g_n x^n+g_{n-1}x^{n-1}+\ldots+g_0x^0$$

Note that, the linear feedback shift registers 80 and 90 shown in FIG. 8 and FIG. 9 are embodiments of the random sequence generator 500 shown in FIG. 5, and utilized for generating pseudo random codes. Those skilled in the art can adjust the structure of the linear feedback shift register 50 or replace with other random sequence generators for generating specific cyclic random sequences, as references used for the gate-on sequence determination unit 504 for determining the gate-on sequence.

The abovementioned embodiments use the random sequence for determining the gate-on sequence of the gate driving signals, which is not a limitation of the present invention. Instead, the present invention can obtain a specific sequence capable of reducing the vertical-line effect according to experiment results and use the specific sequence for displaying images afterward.

For example, if the specific sequence is composed of "0" and "1", "0" can be set to be corresponding to a first gate-on sequence: G1, G2, G3, G4 . . . G(2*n*−1), G2*n*, while "1" can be set to be corresponding to a second gate-on sequence: G2, G1, G4, G3 . . . G2*n*, G(2*n*−1). Moreover, if the specific sequence capable of reducing the vertical-line effect is 0110011001100 . . . , gate-on sequences corresponding to the same scan line between adjacent frames may be different when displaying images. Take the first scan line for example. If the corresponding sequences are 01 and 10, gate-on sequences of adjacent frames are different. On the other hand, if the corresponding sequences are 00 and 11, gate-on sequences of adjacent frames are the same. Obviously, using the former sequences for displaying images, gate-on sequences corresponding to continuous four frames change accordingly, so as to lower the vertical-line effect.

Figure 10:
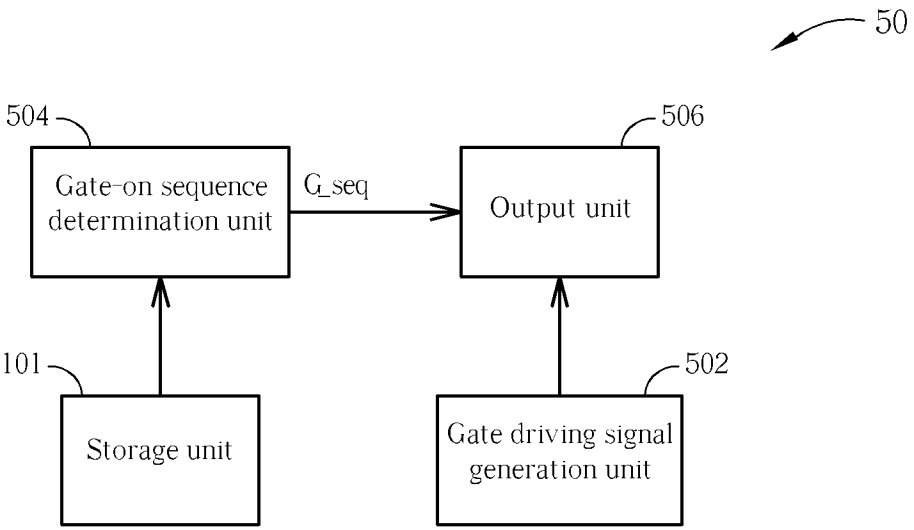
FIG. 10 illustrates a schematic diagram of replacing a random generator shown in FIG. 5 with a storage device.

In other words, the random sequence generator 500 of the former embodiment is an optional device and utilized for increasing the randomness of the gate-on sequence. However, if the specific sequence can reduce the vertical-line effect, the present invention can directly use the specific sequence to reduce circuit complexity and production cost instead of using the random sequence generator 500. For example, in FIG. 10, the random sequence generator 500 is replaced with a storage unit 101 storing specific sequences capable of reducing the vertical-line effect.

In conclusion, the present invention determines the gate-on sequence of gate driving signals according to the random sequence and drives pixels of the LCD panel using the plurality of gate driving signals according to the gate-on sequence for displaying images. Therefore, the present invention can change the gate-on sequence of gate driving signals according to the random sequence and reduce the vertical-line effect by vision persistence, and enhance image quality.

Those skilled in the art will readily observe that numerous modifications and alterations of the device and method may be made while retaining the teachings of the invention.

What is claimed is:

1. A driving method for a liquid crystal display panel comprising:

generating a random sequence;

generating a plurality of gate driving signals;

determining a gate-on sequence of the plurality of gate driving signals in each frame according to the random sequence; and driving pixels of the liquid crystal display panel using the plurality of gate driving signals according to the gate-on sequence for displaying images, wherein a value of an element of the random sequence is identical with a value of another element of the random sequence, and the random sequence is a binary random sequence.

2. The driving method of claim 1, wherein each row of the liquid crystal display panel is driven by at least two gate driving signals of the plurality of gate driving signals.

3. The driving method of claim 1, wherein the step of determining the gate-on sequence of the plurality of gate driving signals in said each frame according to the random sequence comprises:

presetting a plurality of gate-on sequences for selecting the gate-on sequence from the plurality of preset gate-on sequences according to the random sequence.

4. The driving method of claim 1, wherein the step of determining the gate-on sequence of the plurality of gate driving signals in said each frame according to the random sequence comprises:

dividing the liquid crystal display panel into a plurality of groups by the gate driving signals; and determining a gate-on sequence of each of the plurality of groups in said each frame according to the random sequence respectively.

5. A driving device for a liquid crystal display panel comprises:

a sequence generator, comprising a random number generator for generating a random sequence;

a gate driving signal generation unit for generating a plurality of gate driving signals;

a gate-on sequence determination unit coupled to the sequence generator for determining a gate-on sequence of the plurality of gate driving signals in each frame according to the random sequence; and an output unit coupled to the gate driving signal generation unit and the gate-on sequence determination unit for driving pixels of the liquid crystal display panel using the plurality of gate driving signals according to the gate-on sequence for displaying images, wherein a value of an element of the random sequence is identical with a value of another element of the random sequence, and the random sequence is a binary random sequence.

6. The driving device of claim 5, wherein the random number generator is a linear feedback shift register for generating the random sequence with cyclic circulation.

7. The driving device of claim 5, wherein each row of the liquid crystal display panel is driven by at least two gate driving signals of the plurality of gate driving signals.

8. The driving device of claim 5, wherein the gate-on sequence determination unit comprises:

a storage unit for storing a plurality of gate-on sequences; and a selector unit coupled to the sequence generator and the storage unit for selecting the gate-on sequence from the plurality of gate-on sequences in said each frame according to the random sequence.

9. The driving device of claim 5, wherein the gate-on sequence determination unit divides the liquid crystal display panel into a plurality of groups by the gate driving signals and respectively determines a gate-on sequence of each of the plurality of groups in said each frame according to the random sequence.

10. The driving device of claim 9, wherein the gate-on sequence determination unit comprises a plurality of secondary determination units respectively corresponding to one of the plurality of groups, each secondary determination unit comprises:

a storage unit for storing a plurality of gate-on sequences; and a selector unit coupled to the sequence generator and the storage unit for selecting the gate-on sequence from the plurality of gate-on sequences in said each frame according to the random sequence.

* * * * *